US009187953B2

(12) United States Patent
Drifka et al.

(10) Patent No.: US 9,187,953 B2
(45) Date of Patent: Nov. 17, 2015

(54) SIDE COLUMN CONFIGURATION FOR OVERHEAD ROLL-UP DOOR ASSEMBLIES

(75) Inventors: Brian Norbert Drifka, Richfield, WI (US); Christopher Gontarski, Sugar Hill, GA (US)

(73) Assignee: RYTEC CORPORATION, Jackson, WI (US)

( * ) Notice: Subject to any disclaimer, the term of this patent is extended or adjusted under 35 U.S.C. 154(b) by 13 days.

(21) Appl. No.: 13/308,326

(22) Filed: Nov. 30, 2011

(65) Prior Publication Data

US 2012/0241105 A1 Sep. 27, 2012

Related U.S. Application Data

(60) Provisional application No. 61/466,913, filed on Mar. 23, 2011, provisional application No. 61/465,698, filed on Mar. 23, 2011, provisional application No. 61/466,922, filed on Mar. 23, 2011, provisional application No. 61/534,356, filed on Sep. 13, 2011.

(51) Int. Cl.

| | |
|---|---|
| ***E06B 9/56*** | (2006.01) |
| ***E06B 9/58*** | (2006.01) |
| ***E06B 9/13*** | (2006.01) |
| *E06B 1/52* | (2006.01) |
| *E06B 3/80* | (2006.01) |

(52) U.S. Cl.

CPC . *E06B 9/581* (2013.01); *E06B 9/13* (2013.01); *E06B 9/58* (2013.01); *E06B 1/522* (2013.01); *E06B 3/80* (2013.01); *E06B 2009/585* (2013.01)

(58) Field of Classification Search

CPC ..... E06B 9/581; E06B 2009/585; E06B 9/58

USPC ..... 160/268.1, 270, 271, 273.1, 133

See application file for complete search history.

(56) References Cited

U.S. PATENT DOCUMENTS

| | | | | |
|---|---|---|---|---|
| 1,997,846 | A | 1/1933 | Armstrong | |
| 3,489,200 | A * | 1/1970 | Recchione | 160/133 |
| 3,796,010 | A * | 3/1974 | Carlson | 49/477.1 |

(Continued)

FOREIGN PATENT DOCUMENTS

EP 0405093 A2 1/1991

OTHER PUBLICATIONS

International Search Report and Written Opinion for International Application No. PCT/US2012/024275 dated May 23, 2012, 14 pages.

*Primary Examiner* — Katherine Mitchell
*Assistant Examiner* — Johnnie A Shablack
(74) *Attorney, Agent, or Firm* — Factor Intellectual Property Law Group, Ltd.

(57) ABSTRACT

An overhead roll-up door assembly for a vertically moving door to permit and prohibit access to an opening in a wall, the door assembly having a flexible door panel and side columns located proximate opposite sides of the opening. The side columns each include an arm configured to engage the door panel as the door panel moves vertically, the arms being configured to move in a first direction in response to a first threshold moment being applied to the arms by the door panel wherein movement of each arm in the first direction prevents the door panel from escaping the side columns. The arms may be further configured to move in a second direction in response to a second threshold moment being applied on the arms by the door panel in a substantially vertical direction perpendicular to and away from the door panel.

3 Claims, 10 Drawing Sheets

(56) References Cited

U.S. PATENT DOCUMENTS

| | | | | | |
|---|---|---|---|---|---|
| 4,601,320 | A | * | 7/1986 | Taylor | 160/271 |
| 5,170,833 | A | | 12/1992 | Taylor et al. | |
| 5,172,744 | A | | 12/1992 | Finch et al. | |
| 5,284,199 | A | | 2/1994 | Finch et al. | |
| 5,379,823 | A | * | 1/1995 | Kraeutler | 160/271 |
| 5,392,836 | A | | 2/1995 | West | |
| 5,482,104 | A | * | 1/1996 | Lichy | 160/273.1 |
| 5,544,690 | A | * | 8/1996 | Magro et al. | 160/133 |
| 5,964,270 | A | * | 10/1999 | Kirkey et al. | 160/273.1 |
| 6,065,525 | A | * | 5/2000 | Wells | 160/273.1 |
| 6,942,003 | B2 | * | 9/2005 | Thompson | 160/268.1 |
| 7,131,481 | B2 | * | 11/2006 | Varley et al. | 160/273.1 |
| 7,231,953 | B2 | * | 6/2007 | Varley et al. | 160/273.1 |
| 7,464,743 | B1 | * | 12/2008 | Berger, Jr. | 160/273.1 |
| 7,516,770 | B2 | * | 4/2009 | Jerry | 160/267.1 |
| 8,109,317 | B2 | * | 2/2012 | Bostyn | 160/273.1 |
| 2007/0131358 | A1 | * | 6/2007 | Iwasaki et al. | 160/133 |
| 2012/0241105 | A1 | * | 9/2012 | Drifka et al. | 160/133 |
| 2013/0061525 | A1 | * | 3/2013 | Drifka | 49/197 |
| 2014/0158313 | A1 | * | 6/2014 | McTavish et al. | 160/270 |

* cited by examiner

SIDE COLUMN CONFIGURATION FOR OVERHEAD ROLL-UP DOOR ASSEMBLIES

RELATED APPLICATIONS

This application claims priority to U.S. Provisional Application Ser. No. 61/466,913 entitled "A DOOR ASSEMBLY HAVING A FLEXIBLE PANEL WHICH IS WOUND AND UNWOUND UPON A DRUM AND HAVING SIDE SUPPORT AND GUIDE COLUMNS WITH CAM STRUCTURES TO IMPEDE BLOW OUT DUE TO WIND LOAD" filed Mar. 23, 2011; U.S. Provisional Application Ser. No. 61/465,698 entitled "A DOOR ASSEMBLY HAVING A FLEXIBLE PANEL WHICH IS WOUND AND UNWOUND UPON A DRUM AND HAVING SIDE SUPPORT AND GUIDE COLUMNS WITH CAM STRUCTURES TO IMPEDE BLOW OUT DUE TO WIND LOAD" filed Mar. 23, 2011; U.S. Provisional Application Ser. No. 61/466,922 entitled "SEGMENTED WIND LOCK CONFIGURATION FOR OVERHEAD ROLL-UP DOORS AND METHOD OF USING SAME" filed Mar. 23, 2011; and, U.S. Provisional Application Ser. No. 61/534,356 entitled "CONTINUOUS WIND LOCK CONFIGURATION FOR OVERHEAD ROLL-UP DOOR" filed Sep. 13, 2011—the contents of all of which are fully incorporated herein by reference.

FIELD OF THE INVENTION

The present invention is related to overhead roll-up door assemblies, and more specifically to a side column configuration for an overhead roll-up door assembly. The side column(s) is/are configured to maintain engagement with a flexible overhead roll-up door panel when a first force or wind load is applied to the door panel while allowing the door panel to disengage if a second force is applied to the door panel or the door panel is impacted by a vehicle or an object.

BACKGROUND OF THE INVENTION

Overhead roll-up doors provide resistance to high winds and/or air pressure. These doors typically include a door panel having opposing side edges that engage with, and are vertically guided in, side columns. In order to enhance the door's resistance to high winds and/or air pressure, the opposing side edges of the door panel may include a thickened edge that engages the side columns when high winds "impact" the door panel. However, using a thickened edge may prevent the door panel and associated edges from disengaging from the side column if the door panel is impacted by an object or vehicle. This, in turn, often leads to damage to one or more of the side columns, door panel, door components, surrounding building structures, the vehicle, and/or any objects located near the door.

One method which has been used to facilitate disengagement of the door panel and thickened edges if the door panel is impacted by an object or vehicle is by making a portion of the side columns disengage-able. For example, U.S. Pat. No. 5,482,104 discloses a side column having a windbar(s) or strip(s) which engage a thickened edge when a wind load is applied to the door. If the door panel is impacted by an object or vehicle, the force imparted on the windbar(s) or strip(s) by the thickened edges will cause the windbar(s) or strip(s) to disengage from the side columns, allowing the door panel and edge to disengage. While such a configuration will allow the door panel to withstand a wind load and disengage if impacted, each time the door panel is disengaged because of an impact, the windbar(s) or strip(s) must be re-attached to the side columns.

Another method which is known in the prior art is to use a spring assembly to allow a portion of the side column to pivot out of the way when a force is applied to it by a thickened edge on a door curtain. For example, U.S. Pat. No. 6,942,003 discloses a side column having a windbar assembly which includes a tension spring capable of compressing when a thickened edge on the door panel applies a force to the windbar. The compression of the spring allows the thickened edge and door panel to escape the side columns. However, such a configuration does not provide for any enhanced wind resistance as the wind load increases, and indeed may allow the door panel to escape under substantial wind loads if the spring compresses. As is known in the art, springs may also break and wear out, lowering the wind locking capabilities of the side column and door panel.

Yet another method known in the prior art is to provide the thickened edge with a sloping face which engages a corresponding sloping surface on the side column and allow for the side column to deform if a force is applied on it by the door panel as a result of the door panel being impacted by a vehicle or object. However, such side columns do not provide any enhancement of the wind resistance of the door as the wind load is increased, inasmuch as the side columns are not designed to move in a manner which prevents the door panel from escaping the side columns.

Therefore, it would be advantageous to design a side column capable of bi-directional movement such that movement in the first direction will increase the wind load resistance of the door and door panel as a first force or the wind load increases while movement in the second direction will allow the door panel to more easily escape the side column if impacted by a vehicle or object.

It would be further advantageous to design a side column capable of providing a wind lock on a vertically moving door panel without utilizing thickened edges in order to allow for easier disengagement of the door panel if it is impacted.

The present invention is directed to solving these and other problems.

SUMMARY OF THE INVENTION

The present invention is directed to a side column configuration for overhead roll-up doors. According to one aspect of the invention, the door assembly includes a flexible door panel capable of moving in a vertical direction to permit and prohibit access to an opening in a wall or similar structure. The door panel includes a first face and a second face extending horizontally across the opening, and opposed vertical sides, wherein each vertical side has a vertical margin extending along the edge of the door panel. In order to guide the vertical movement of the door panel, the door assembly includes guide or side columns configured proximate opposite sides of the opening, wherein each guide or side column is configured to engage at least a portion of one of the vertical margins. The door assembly may further include a header that houses any un-rolled portion of the door panel. The header may be supported by at least a portion of the side columns.

According to another aspect of the invention, each side column includes an arm configured to move in a first and second direction in response to a moment of force (moment) or torque being applied to the arm by the door panel. Force may be applied on the arm as a result of a load or force being applied on the door panel, causing the door panel to bow in the direction of the force. As the door panel bows, the marginal edges of the door panel may engage the arm, imparting a force thereon, the force having components inwards towards the center of the panel and outwards away from the panel. Under uniformly distributed loads, like for example ordinary wind loads, the door will bow very little and the moment of force imparted on the arm by the door panel will typically have a greater inward component as the panel tries to just pull the edge through the column. When a point or contact load is applied to the door panel, like for example from an impact by a vehicle, the moment of force imparted on the side columns will increase and have a greater outward component. Therefore, the arm may be configured to move in a first direction in response when a moment of force at or above a first threshold is applied to the arm by the door panel, the force having a primarily inwards component. Once the moment of force applied to the arm reaches a second (higher) threshold and has a primarily outwards component as the door panel bows further in the direction of the force, the arm may be configured to move in a second direction.

It should be understood that the threshold moments and/or forces causing the arm to move in either the first or second direction discussed herein are with respect to the moment applied to the arms of the side columns by the door panel and not the force applied on the door panel, by for example a wind load or vehicle impact. This distinction is important insofar as a uniformly distributed force over the door panel, like for example a wind load, will result in less moment being applied on each arm than a substantially identical point or contact force from a vehicle at some point along the door panel. For example, in some embodiments of the present invention, a 1,000 lb wind load on the door panel may result in a 10,000 in-lbs moment on the arm, while a 1,000 lb impact from a vehicle centered in the middle of the door panel may result in a 15,000 in-lbs moment on each arm. As the impact moves towards one arm or the other, the moment imparted by the impact on the closer arm will increase while the moment on the opposite arm decreases. Utilizing the above as an example, a first threshold for each arm may be set at 5,000 in-lbs moment so that the arm will start moving in the first direction once that level of force is applied to each arm with the arm fully moved in the first direction at a moment of 10,000 in-lbs. The second threshold may then be set at 15,000 in-lbs so that if a vehicle impacts the door panel with 1,000 lbs of force, the arm will move in the second direction to allow the door panel to escape from the arm and side column to prevent damage to the door assembly, the vehicle and any surrounding structures or people. As seen from this example, the level of force applied to the door panel will not necessarily result in a constant reaction by each arm, as it is the moment of force on each arm by the door panel that dictates movement in the first and/or second direction.

According to yet another aspect of the invention the door panel may include thickened edges extending along the vertical margins of the door and being configured to engage each respective arm as the door panel moves vertically.

According to still another aspect of the invention each side column includes a fixed portion. The fixed portion of the side column includes a first portion which attaches to the arm and a second portion which may support the header of the door assembly. The second portion may additionally be configured to form a boundary of a gap with the arm through which the door panel extends from the opening to the interior of the side column, and through which the edge of the door panel must pass in order for the door panel to disengage from the side column if the panel is impacted by a vehicle or an object. Movement of the arm in the first direction may reduce the size of the gap and pinch the door panel, increasing the wind load resistance for example, and preventing the door panel from escaping the side column. Movement of the arm in the second direction may allow the door panel to escape the side columns. In order to better facilitate disengagement of the door panel from the side column, moment forces above the second threshold may also cause movement in the second direction of a portion of the first portion of the fixed structure.

According to another aspect of the invention, the arm and first portion of the fixed structure may include slots, through holes, apertures or similar structures through which one or more fasteners may fasten the arm to the fixed body. The length of the arm, or the distance that the arm extends towards the center of the door or opening, may be adjusted by aligning different slots or apertures in the arm with different slots or apertures in the fixed structure. Adjusting the length of the arm and the portion of the arm which overlaps with the first portion of the fixed structure will increase or decrease the ease with which the arm will move in the second direction. For example, a shorter arm with greater overlap will move in the second direction less easily than a longer arm with less overlap.

According to one aspect of the invention, each side column may include two arms, each arm being capable of moving in a first and second direction in response to different forces. For example, each arm may be configured to move in a first direction in response to moment forces being applied at or above a first threshold, while each arm is also configured to move in a second direction in response to moment forces being applied at or above a second threshold. The two arms may be configured so that the second direction of the first arm is substantially opposite that of the second direction of the second arm.

In this embodiment, the two arms may be attached using a fixed body wherein a portion of each arm faces each other, forming a gap between which the door panel may extend into the side columns from the opening and through which the edge of the door panel must pass to disengage from the side column if the panel is impacted by a vehicle or an object.

Other aspects and features of the invention will become apparent to those having ordinarily skill in the art upon review of the following Description, Claims, and associated Drawings.

DETAILED DESCRIPTION OF THE PRESENT INVENTION

Figure 1:
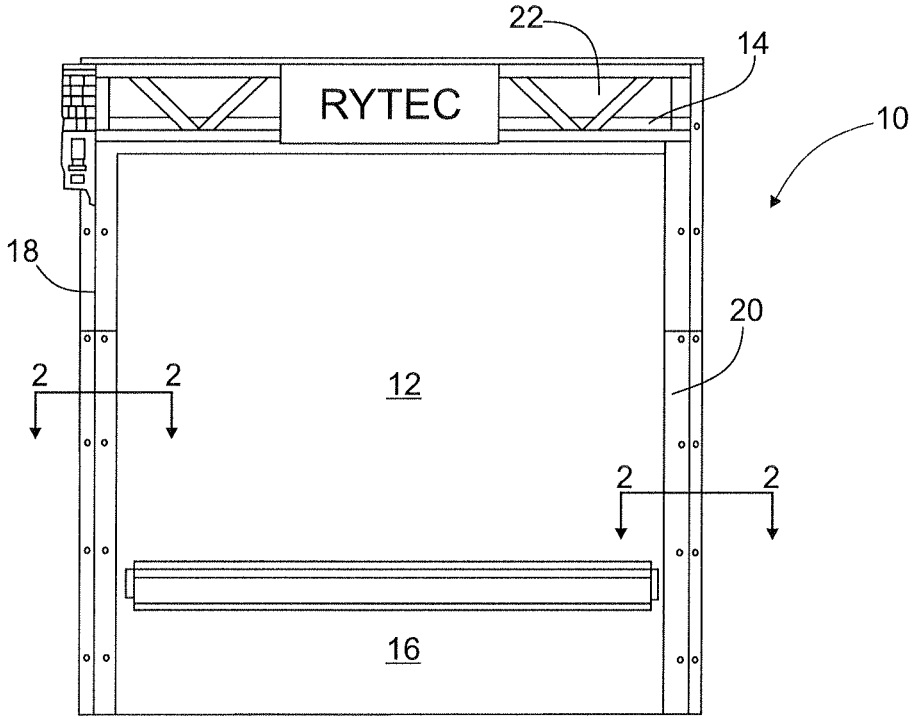
FIG. 1 is a front view of a door assembly as contemplated by the invention.

While the present invention is susceptible of embodiment in many different forms, there is shown in the drawings and will herein be described in detail, preferred embodiments of the invention with the understanding that the present disclosure is to be considered as an exemplification of the principles of the invention and is not intended to limit the broad aspect of the invention to the embodiments illustrated.

FIG. 1 shows an overhead roll-up door assembly as contemplated by the present invention. Door assembly 10 includes a flexible roll-up door panel 12, that is vertically moved by being wound and unwound from drum or shaft 14 to permit and prohibit access to opening 16. The door panel includes first and second faces, and first and second opposed vertical sides located on opposite sides of the opening, each vertical side having a marginal edge. In order to guide the vertical movement of the door panel, side columns 18, 20 are located proximate opposing sides of the opening. The side columns each have an arm (such as arm 24 shown in FIG. 2) configured to engage at least a portion of each respective marginal edge. The door assembly may further include a header 22 for housing the drum or shaft and any unwound portion of the door panel. The header may be supported, at least in part, by at least a portion of side columns 18, 20.

Figure 2:
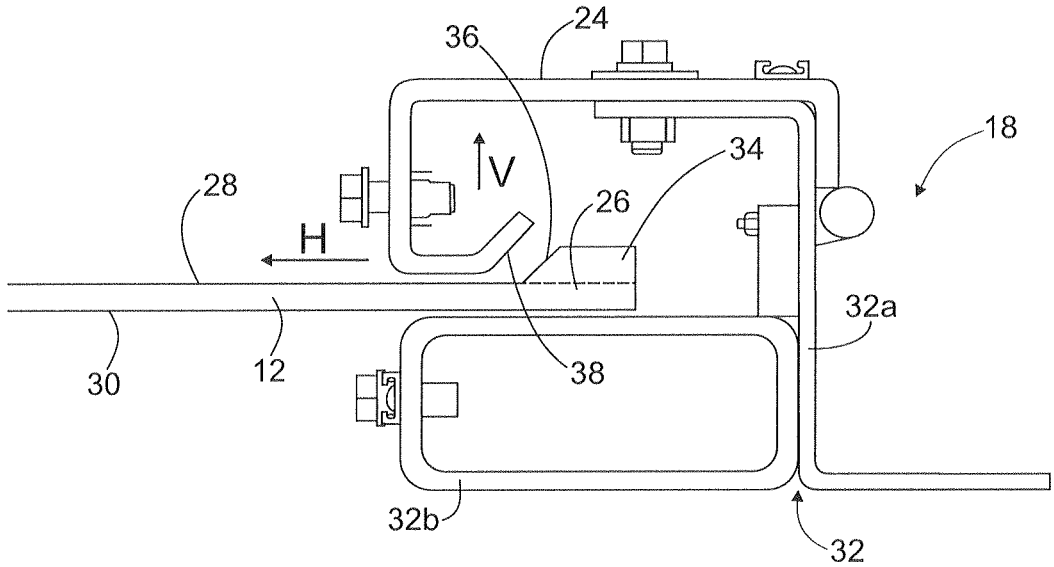
FIG. 2 is a cross-sectional view of an embodiment of a side column and door panel along line 2-2 of FIG. 1 as contemplated by the invention.

The configuration of each side column is better shown in FIG. 2 which is a cross-sectional view of side columns 18, 20 along line 2-2 in FIG. 1. While the invention will be discussed with respect to side column 18, it should be appreciated by those having ordinary skill in the art that the cross-sectional view and construction of side column 20 is substantially identical and any features discussed herein may apply to both side columns 18, 20.

Side column 18 includes arm 24 which is configured to move in two directions depending on the amount and direction of the primary component of the moment of force imparted on the arm by the door panel as a result of a force or load being applied to the door panel itself causing the door panel to bow. The arm may move in a first direction—shown by direction H—when a moment is applied on the arm by the door panel at or above a first threshold and has primarily an inwards component towards the center of the panel, and move in a second direction—shown as direction V—when the moment applied on the arm is at or above a second threshold and has primarily an outwards component away from the face of the door panel. As will be further explained herein, movement of arm 24 in the first direction will help prevent door panel 12 from escaping the side column while movement of the arm in the second direction will allow door panel 12 to more easily escape the side columns. Though shown as engaging the marginal edge of first face 28, it should be appreciated by those having ordinary skill in the art that that arm 24 may be reversed and engage the marginal edge of second face 30. Where second face 30 is configured to engage the side column, it should be appreciated by those having ordinary skill in the art that direction V would extend away from face 30 and be substantially perpendicular thereto.

The configuration of arm 24 and which face it engages may be dictated by the direction of travel through the door and/or the direction of any wind load or air pressure which may be applied to the door panel. For example, if the common direction of travel is towards face 30 while face 28 is typically presented with a wind load, the configuration in FIG. 2 may be utilized wherein face 28 engages the arm. Conversely, if the direction of travel is typically towards face 28 while face 30 is presented with a wind load, side column 18 may be flipped on that arm 24 engages the marginal edge along face 30. It should be understood however, that these are just examples and that no matter the configuration the arm may be configured to move in either the first or second direction in response to forces being applied to either face of the door panel.

In some alternative embodiments it may be advantageous to provide side column 18 with a first arm 24*a* and a second arm 24*b*, wherein both arms are capable of moving in response to forces imparted by the door panel, in the first and second directions, H and $V_1$ and $V_2$, respectively. When utilizing two arms, the direction of movement in the second direction of each arm is substantially opposite of the other so as to allow for the edge of the door panel to break away from the side column due to impacts in both directions.

Returning to FIG. 2, as shown therein, side columns 18, 20 may also include a "fixed" portion 32 having first portion 32*a* and second portion 32*b*. Arm 24 is configured to attach to first portion 32*a* while portion 32*b*, along with a portion of arm 24, bounds gap G through which door panel 12 extends from the opening into side columns 18, 20. Gap G is also what the edge of door panel 12 must pass through in order to disengage from the side column. Portion 32*b* of the fixed portion may also be used to support header 22 of the door assembly.

As also seen in FIG. 2, in a preferred embodiment, a thickened edge 34 may be attached proximate each marginal edge 26 of door panel 12. Thickened edges may be utilized to further enhance the wind load resistance of the door panel by providing a thicker area which may engage the side columns when a wind load is applied to the door panel. In order for the door panel to disengage from the side columns, this thicker area must pass through gap G. Typically, the thickness of the thickened edge area and the door panel is greater than the width of gap G—thereby preventing the door panel and thickened edge from disengaging from the side column under an ordinary wind load or the like.

In order to enhance the wind load resistance of the door while at the same time allowing for disengage-ability of the door panel if impacted by a vehicle or object, thickened edge 34 of may be continuous or segmented and may include a sloped face 36. In order to attempt to maintain some of the disengage-ability of the door panel in response to impacts, arm 24 may include a corresponding sloped face 38 which is configured to engage sloped face 36 of the thickened edge of the door panel.

In addition to being sloped, and regardless of whether the thickened edges are continuous or segmented, it is contemplated by the invention that the face of the thickened edges have two or more ribs with a gap located between each rib. Utilizing a rib-faced thickened edge increases the wind load resistance provided by the thickened edge inasmuch as it adds a compression and frictional component on the face of the edge that the wind load must overcome to disengage the door panel from the side column. The ribbed configuration also enhances the ability of the door panel to disengage from the side column if the door is impacted by a vehicle or an object inasmuch as in addition to forcing the side column to move in the second direction, the ribbed face will also compress into the gaps between each rib—thereby decreasing the thickness of the edge which must pass through the side column.

When utilizing a ribbed face, it should be understood that the ribs may be of varying thicknesses and depth, and may have a different durometer and/or be made from a different material than each other and/or the rest of the thickened edge. For example, the ribbed portions of the thickened edges may have a higher durometer than the remainder of the thickened edge in order to prevent wear on the engaging ribbed portion while providing more wind load resistance by being less easy to deform. Making the non-ribbed portion of the thickened edge a lower durometer will help the non-ribbed portion deform more easily when the door panel is impacted, allowing the non-ribbed portion to more easily pass through the gap and disengage from the side column.

The operation and movement of arm 24 in both the first and second directions can be more easily seen in FIGS. 4A-4C and 5A-5C.

As a substantially uniformly distributed force or load is applied to door 12, like for example a wind load, it will cause the door panel to bow in one direction, pulling the edges of the door panel towards the opening. Once the load on the door panel reaches a particular amount, the edges of the door panel will be pulled close enough to the opening to move from the non-moved or non-load position, shown for example in FIG. 2, to an engaged position shown for example in FIGS. 4A and 5A where marginal edges 26 engage arm 24. Once engaged, the marginal edges of the door panel will begin imparting a moment and force on the side columns. Initially, the directional component of the force imparted on the side columns will be primarily horizontal or towards the interior of the opening or door panel as the panel only slightly bows as a result of a load or force being applied thereto.

Figure 4A:
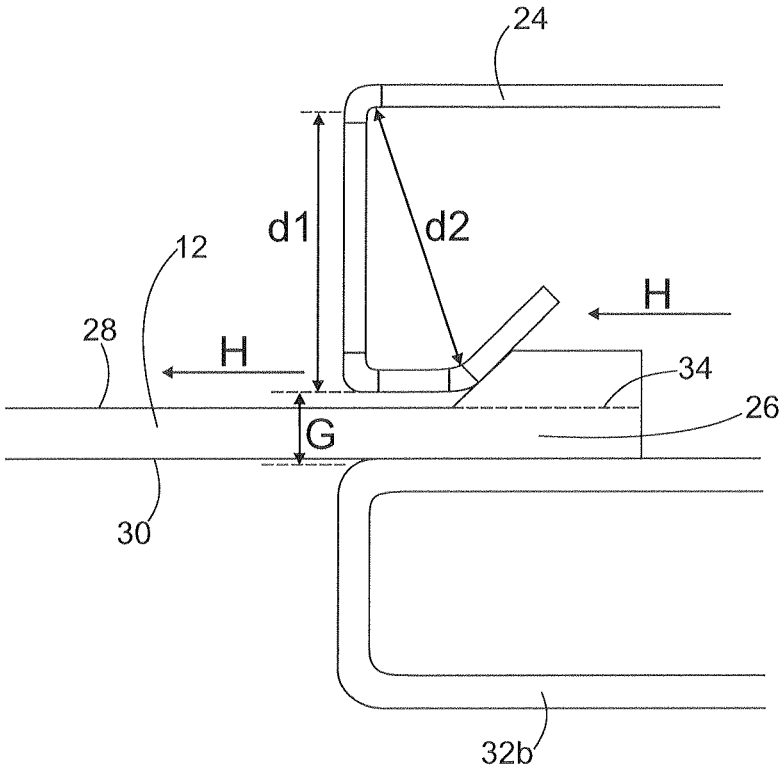
FIG. 4A is a view of a portion of the side column and door panel in FIG. 2 when a substantially horizontal force is applied to the side column by the door panel.
Figure 4B:
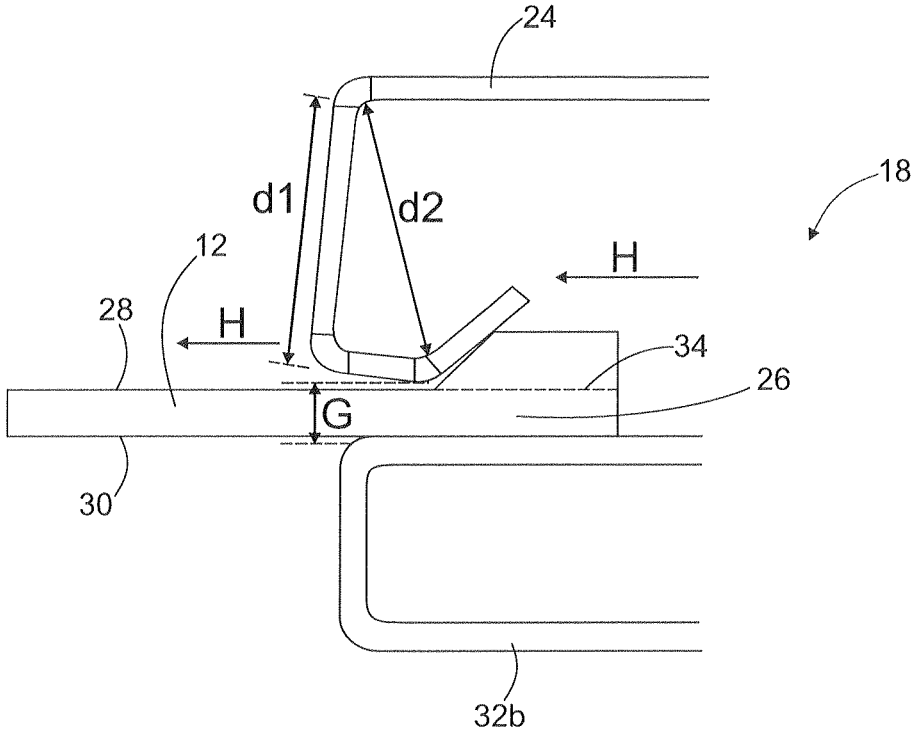
FIG. 4B is a view of a portion of the side column and door panel in FIG. 2 when a substantially horizontal force is applied to the side column by the door panel.
Figure 4C:
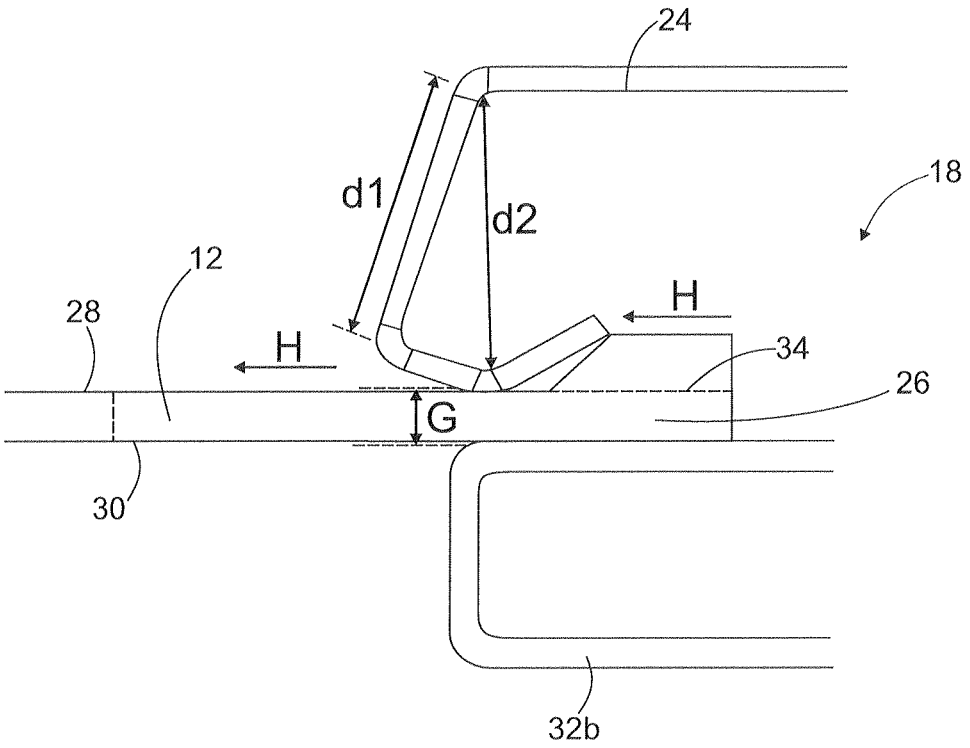
FIG. 4C is a view of a portion of the side column and door panel in FIG. 2 when a substantially horizontal force is applied to the side column by the door panel.

Once the moment and/or force applied to each arm by the door panel reaches a certain threshold in the horizontal direction, arm 24 will begin moving in the first direction as shown in FIGS. 4B and 4C. As the moment and/or force on the arm builds from the first threshold, for example as the wind load increases on door panel 12, the arm will continue moving in the first direction, narrowing gap G, causing the side column to "pinch" the door panel in the gap, preventing the door panel from escaping. The narrowing of gap G and pinching of the door panel will effectively increase the wind load resistance of the door assembly, as the narrowing and pinching will substantially prevent the door panel from blowing out and escaping the side columns.

The portion of the arm which moves in the first direction may be a spring arm or biased against the door panel from a hinge or pivot point. If a spring arm is used, or the portion of the arm moving in the first direction is spring biased against the door panel, it will move in the first direction and remain in a moved position until the moment and/or force on the arm is dropped below the first threshold. The spring arm may be made using a spring back metal, a flexible and resilient polymer, or may be hinged and biased by a spring of the like which is compressible once a certain threshold moment and/or force is applied thereto through the engagement of the panel and the arm.

Rather than, or in addition to, being spring biased, it is contemplated by the invention that the arm may include a cam like structure to take the substantially linear force applied by the door panel in the primarily inwards direction on the arm and use it to rotate at least a portion of the arm about a hinge or pivot point in the first direction. The cam like structure may include an angular or rounded portion proximate the portion of the arm which engages the door panel causing the force imparted by the panel to effectively rotate the arm in the first direction. As additional force is applied on the angular or rounded portion of the arm by the door panel, the arm may be caused to rotate further in the first direction, reducing the size of gap G.

Figure 3:
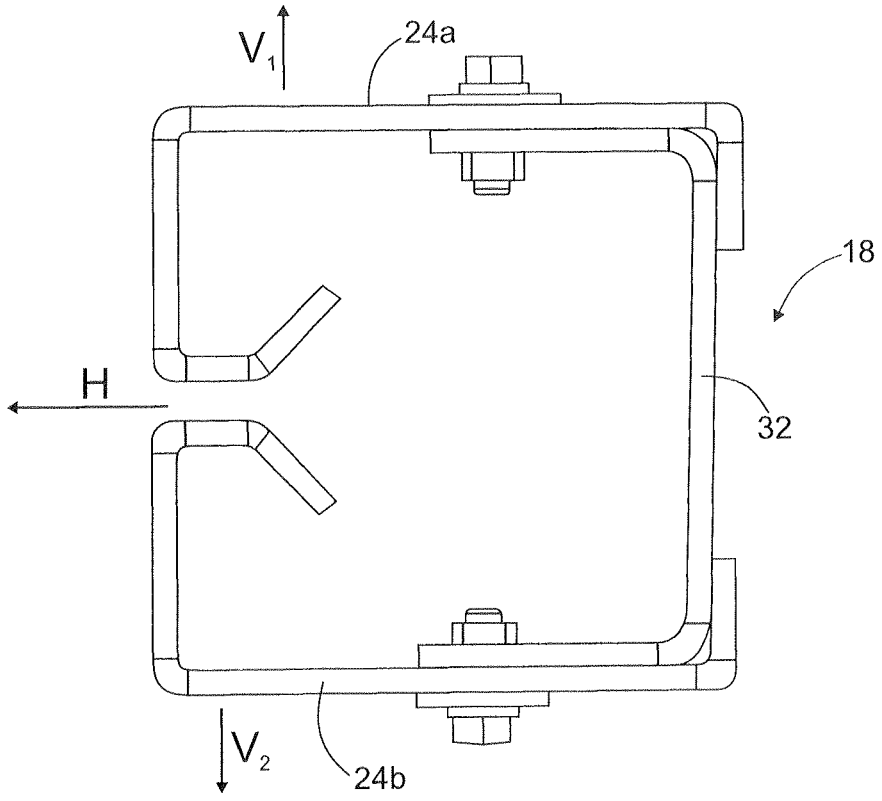
FIG. 3 is a cross-sectional view of an embodiment of a side column along line 2-2 of FIG. 1 as contemplated by the invention.
Figure 6:
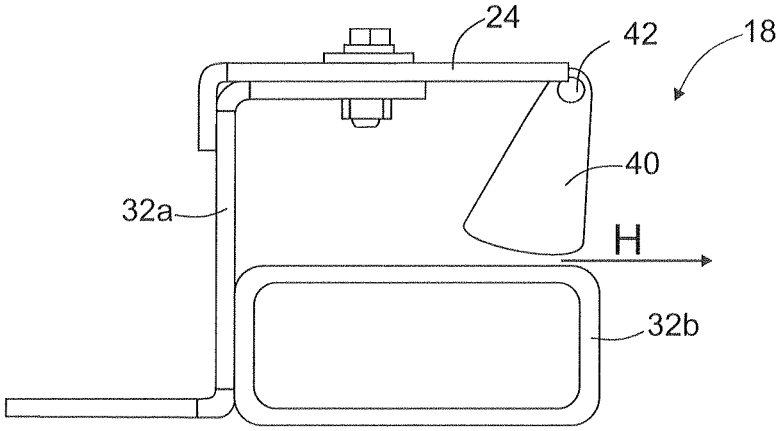
FIG. 6 is a cross-sectional view of an embodiment of a side column and door panel along the line 2-2 of FIG. 1.
Figure 7:
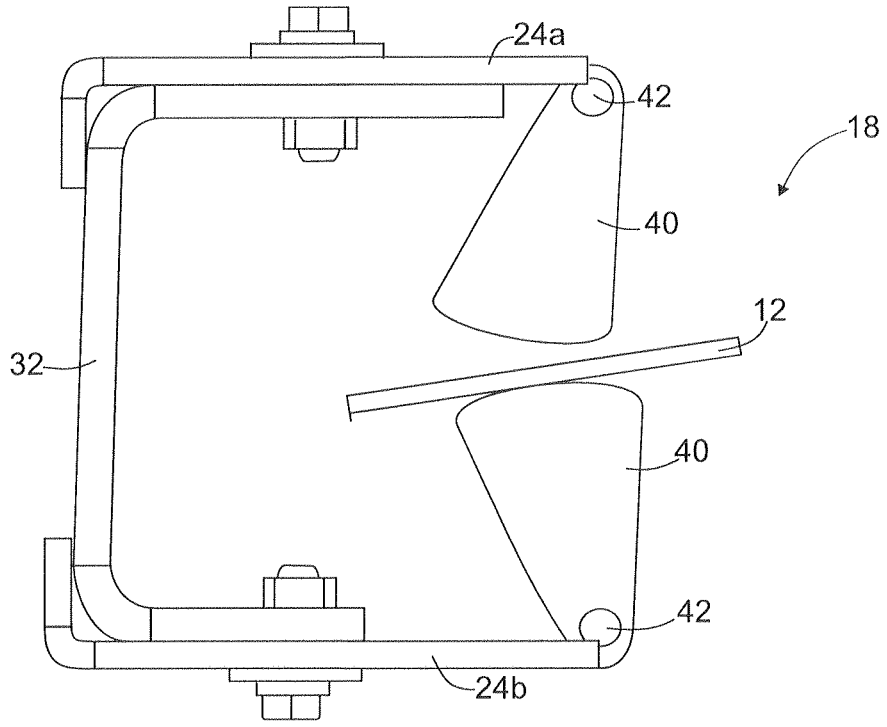
FIG. 7 is a cross-sectional view of an embodiment of a side column and door panel along the line 2-2 of FIG. 1.

Alternatively, as seen in FIGS. 6 and 7, arm 24 may include a body 40 which is rotated at one end about pin or hinge 42 while bounding the gap through which the door panel extends into side column at the other end. The body may be made of any rigid or semi-rigid material capable of holding its form when a force substantially towards the interior of the door panel is applied, and may be, for example, an extruded aluminum body. When utilizing a body, the moment and/or force of and resulting friction created by the door panel and/or thickened edge engaging the body will cause the body to rotate in the first direction. As seen in FIG. 7, like when using arm 24 as shown in FIGS. 2 and 3, it is contemplated by the invention that two arms each having a body rotatably attached may be used to form gap G. Utilizing a cam structure like that shown in FIGS. 6 and 7 may be particularly advantageous when no thickened edges are attached to the door panel, inasmuch as the bodies are capable of rotating between the first moved position and the non-moved position based entirely on the friction of the door panel engaging the body. As the body rotates, the body will pinch and lock the door panel in place, preventing it from escaping from the side column.

Whether the embodiment of arm 24 shown in FIG. 2, 4A, or 6 is used, in order for movement of the arm in the first direction to successfully reduce gap G, the portion of the arm which engages the door panel when the arm is moved in direction H must be further from the hinge or pivot point of the arm than the point bounding gap G when the arm is in the a non-moved position. Looking at FIGS. 4A, 4B, 4C, and 6 this means that length d1 from the hinge or pivot point of the arm to the point or surface bounding gap G when in a non-moved position must be less than the length d2 from the hinge or pivot point to substantially the innermost point which engages the door panel when moved in the first direction. When d2 is greater than d1, the size of gap G will effectively reduce by an amount of d2-d1 as the arm moves in the first direction. D2 and d1 may be configured longer or shorter in order to adjust the increase of wind load resistance of the side column resulting from movement in the first direction to match a particular door panel or required resistance.

Figure 5A:
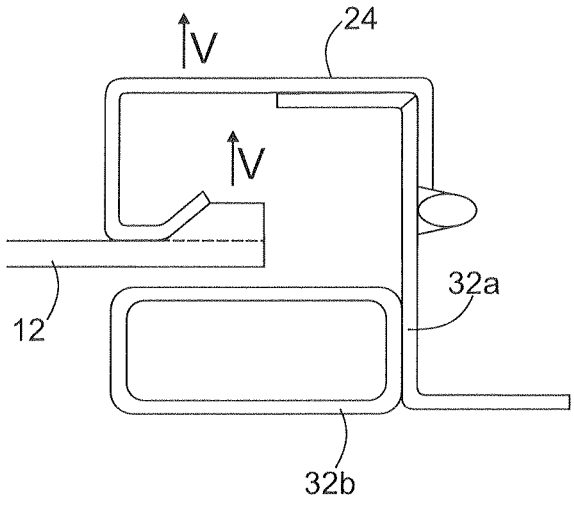
FIG. 5A is a view of the side column and door panel in FIG. 2 when a substantially vertical force is applied to the side column by the door panel.
Figure 5B:
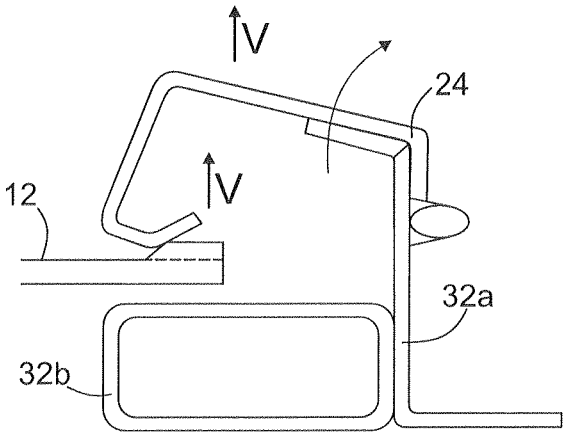
FIG. 5B is a view of the side column and door panel in FIG. 2 when a substantially vertical force is applied to the side column by the door panel.
Figure 5C:
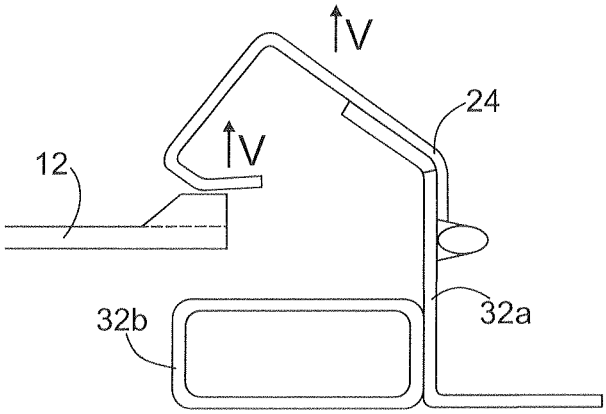
FIG. 5C is a view of the side column and door panel in FIG. 2 when a substantially vertical force is applied to the side column by the door panel.

In order to avoid damage to the door panel, side columns and any other door assembly or building components, increasing the moment or force applied to the arm to a second threshold—like for example when a vehicle impacts the door causing a point or impact load—may cause the arm to move in the second direction which allows the door panel to disengage from the side columns. As seen in FIGS. 5A-5C, movement of arm 24 in the second direction (designated by direction V) will result in gap G to increasing so door panel 12 may escape the side columns.

In order to permit movement in the second direction, a second portion of arm 24 may be a spring arm or similar structure, or alternatively may be spring biased in place. Any spring arm or spring biasing used to facilitate movement in the second direction will require a different (higher) moment and/or force be applied to the arm before it moves or deflects from its non-moved position than the portion capable of movement in the first direction. As with the use of a spring arm or spring biasing to allow the arm to move in the first direction, once the moment and/or force causing the arm to move in the second direction is dropped below the second threshold, the arm may return to its original, non-moved position.

In addition to arm 24 being moved in the second direction, it is contemplated that a portion of fixed structure 32, and in particular a portion of first portion 32*a* of the fixed structure, be capable of moving in the second direction with the arm. Movement of at least a portion of the first portion of the fixed structure is particularly useful if the arm is fastened or attached to it. Alternatively, it is also contemplated that in some embodiments only the portion of the arm which is not attached to the first portion of the fixed structure may move in the second direction to widen the gap and allow the door panel and/or thickened edges to escape. Allowing only the unattached portion of the arm to move may allow for greater resistance against movement in the second direction, and may allow for increased control on the amount of moment and/or force required to move the arm in the second direction.

Figure 8:
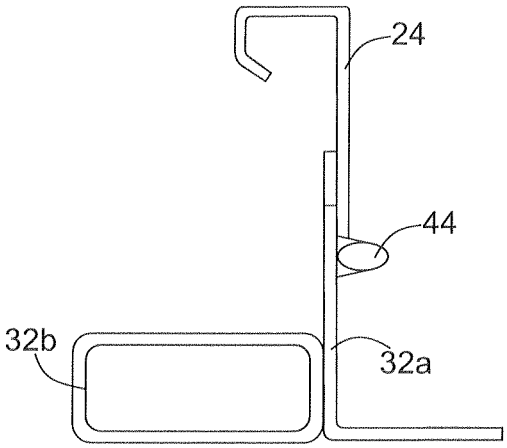
FIG. 8 is a view of the side column and door panel of an embodiment of the invention when a substantially vertical force is applied to the side column by the door panel; and, FIG. 9 is a cross-sectional view of an embodiment of a side column and door panel along the line 2-2 of FIG. 1.

In some embodiments of the invention, rather than utilizing a spring arm or some other spring biasing, it is contemplated by the invention that arm 24 may be hinged or spring biased in a manner which allows the entire arm to move in the second direction by opening the entire arm and almost instantaneously moving to an open position as shown in FIG. 8. In such embodiments a spring or other biasing mechanism known in the art 44 may be used to hold the arm in the non-moved position, with a second moment and/or force threshold applied the arm causing the arm to move in the second direction, immediately opening of the side column and releasing of the door panel. Once the moment and/or force on the arm reaches the second threshold, the spring or biasing mechanism may almost instantaneously release, moving the arm in the second direction and ultimately to the open position. Once the arm is moved to the open position, the door panel is no longer engaged with the side column and may freely escape there from. When utilizing a hinge, spring, or other biasing mechanism which allows the arm to open completely, any portion of first portion 32*a* of fixed structure 32 attached to the arm may be hinged to allow movement with the arm when the arm is moved to the second position. Once the arm moves in the second direction, it may remain in that position until returned to the original non-moved position. Movement from the open position to the originally non-moved position may be accomplished through automated movement of the arm using an actuator or a motor attached at one end of the arm, or may be done manually by pushing the arm back into place.

In embodiments where the arm is a spring arm or a similar structure, the amount of moment and/or force required to move the arm in the second direction may be affected by the material used to create the arm, the thickness of the material used to create the arm, and/or by treating the material used to make the arm to make it more or less flexible. While some of these factors may be adjustable in a completed door assembly, generally speaking adjustments to any of these may be impossible or only provide a minimal change in the moment and/or force required to move the arm in the second direction.

Therefore, in order to increase or decrease the amount of moment and/or force required to move the arm in the second direction, it is contemplated by the invention that additional plates, i.e. gusset plates, may be attached to the arm and/or the length of the arm may be adjusted.

Figure 9:
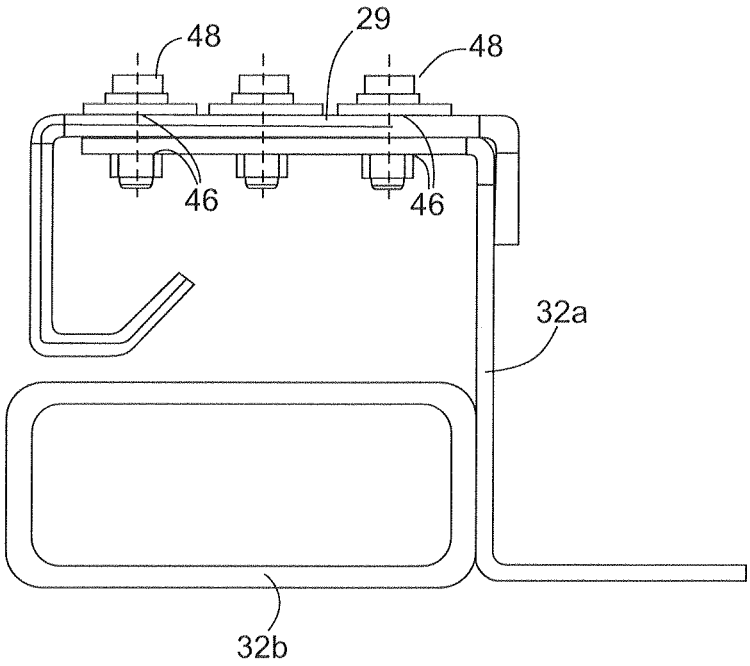

In order to provide for such adjustments, as seen in FIG. 9 arm 24 and first portion 32*a* of fixed structure 32 to which the arm attaches may be provided which matching slots, through holes, apertures 46 or the like through which fasteners 48 may be placed to attach the arm and first portion of the fixed structure. Examples of fasteners which may be used include but are not limited to washers, nuts, and bolts or screws; clamps; or, rivets. In order to increase the moment and/or force required to move the arm in the second direction, a gusset plate may be attached to arm 24. The gusset plate may be attached by providing matching slots, removing any fasteners, aligning the slots in the gusset plate with the slots in the first portion of the fixed structure and the arm, and replacing the fasteners. In order to further enhance the stiffness of the arm, in addition to being fastened, any gusset plates may be directly welded or otherwise attached to the arm in a substantially non-removable manner.

Using a slot and fastener configuration may also allow for the length of the arm to be adjusted. For example, removing the fasteners may allow the arm to be lengthened or shortened by aligning different slots in the arm with different slots in the first portion of the fixed structure. Lengthening the arm in a manner where less of the arm is overlapping the fixed structure may allow for the arm to more easily move in the second direction—particularly if no portion of the first portion 32*a* is hinged and the arm is fastened directly thereto. Conversely, shortening the arm in manner where more of it overlaps with the fixed structure may increase the force required to move the arm in the second direction.

Another method which may be used to regulate or adjust the moment and/or force required to move the arm in the second direction when using a slot and fastener configuration is by adjusting the tightness or number of fasteners used to attach the arm to the fixed structure. If, for example, washers, nuts, and bolts are used to attach the arm to the fixed structure, the bolts closest to the opening may be loosened or removed to allow the arm to move in the second direction without moving a portion of the fixed structure. Allowing freer movement of a portion of arm 24 may allow for easier opening of gap G, enhancing the ability of the door panel and/or thickened edges to escape the side columns.

The above-described embodiments of the present invention are intended to be examples only. Alterations, modifications and variations may be effected to the particular embodiments by those of skill in the art without departing from the scope of the invention, which is defined by the claims appended hereto.

What is claimed is:

1. An overhead roll-up door assembly for a vertically moving door to permit and prohibit access to an opening in a wall, the door assembly comprising:

a flexible door panel having at least one face and opposed vertical sides, each vertical side having a vertical margin along an edge of the door panel;

at least two side columns, positioned so that at least one side column is located proximate each side of the opening, each side column having an arm configured to engage the vertical margins of the door panel as the door panel moves vertically, each side column having a fixed portion;

an arm, the arm having a pivot point, a first point and a second point, the pivot point being separated from the first point by a first distance and the second point by a second distance, the second distance being greater than the first distance, wherein the arm and a portion of the fixed portion define a gap, wherein during normal operation, the first point and the portion of the fixed portion define a first gap width, and movement of the arm in a first direction about the pivot point causes the second point to pinch the door panel as the portion of the fixed portion and the second point define a second gap width, wherein the second gap width is less than the first gap width.

2. The invention of claim 1 wherein the second point is located further from the opening than the first point.

3. The invention of claim 1 wherein each arm includes a second pivot point, wherein movement of the arm about in a second direction about the second pivot point causes the gap to widen to allow the door panel to escape the side column through the gap.

* * * * *